US009850631B2

(12) United States Patent
Curci

(10) Patent No.: US 9,850,631 B2
(45) Date of Patent: Dec. 26, 2017

(54) FAN-SHAPED PEDESTRIAN BARRIER

(71) Applicant: PH-15 S.R.L., Bisceglie (BA) (IT)

(72) Inventor: Vittorio Curci, Bisceglie (IT)

(73) Assignee: PH-15 S.R.L., Bisceglie (BA) (IT)

( * ) Notice: Subject to any disclaimer, the term of this patent is extended or adjusted under 35 U.S.C. 154(b) by 0 days.

(21) Appl. No.: 15/116,665

(22) PCT Filed: Jan. 30, 2015

(86) PCT No.: PCT/IB2015/000098
§ 371 (c)(1),
(2) Date: Aug. 4, 2016

(87) PCT Pub. No.: WO2015/118399
PCT Pub. Date: Aug. 13, 2015

(65) Prior Publication Data

US 2016/0348416 A1 Dec. 1, 2016

(30) Foreign Application Priority Data

Feb. 4, 2014 (IT) ..... BA14A0006

(51) Int. Cl.
*E01F 13/04* (2006.01)
*E01F 13/08* (2006.01)
*B61B 1/02* (2006.01)
*E06B 9/00* (2006.01)

(52) U.S. Cl.
CPC ..... *E01F 13/08* (2013.01); *B61B 1/02* (2013.01); *E01F 13/044* (2013.01); *E01F 13/085* (2013.01); *E06B 2009/002* (2013.01)

(58) Field of Classification Search
CPC ..... E01F 13/08; E01F 13/06; E01F 13/048; E01F 13/12; E01F 13/123; E01F 13/046; E01F 13/024; E01F 13/04; E01F 15/146; E01F 15/148; E01F 15/47; E01F 15/49; E01F 15/70; E01F 15/53; E01F 15/51; E01F 15/605; E06B 2009/002; E06B 5/10; B61B 1/02
USPC ..... 406/6
See application file for complete search history.

(56) References Cited

U.S. PATENT DOCUMENTS 4,490,068 A * 12/1984 Dickinson ..... E01F 13/08 404/11
4,627,763 A * 12/1986 Roemer ..... E01F 13/08 404/11
4,923,327 A * 5/1990 Gorlov ..... E01F 13/046 404/6

(Continued)

FOREIGN PATENT DOCUMENTS

DE 202012000092 U1 2/2012
EP 1717124 A1 11/2006
WO 2006131018 A1 12/2006

OTHER PUBLICATIONS

International Search Report for corresponding International Application No. PCT/IB2015/000098.

*Primary Examiner* — Justin Rephann
(74) *Attorney, Agent, or Firm* — Egbert Law Offices, PLLC

(57) ABSTRACT

Retractable floor barriers are provided that can be quickly opened and closed by pneumatic actuators and operated by the closing and opening of an electrical circuit. The retractable floor barriers can be used at the docks of trains and subway stations to prevent accidental falls therefrom.

7 Claims, 4 Drawing Sheets

(56) References Cited

U.S. PATENT DOCUMENTS

| | | | | |
|---|---|---|---|---|
| 5,228,237 | A * | 7/1993 | Nasatka | E01F 13/085 404/6 |
| 7,494,112 | B2 * | 2/2009 | Fromm | E01F 13/12 256/64 |
| 7,581,351 | B2 * | 9/2009 | Lewis | E01F 13/048 404/6 |
| 8,128,310 | B2 * | 3/2012 | Dindl | E01F 13/12 404/10 |
| 8,292,538 | B2 * | 10/2012 | Morgan | E01F 13/06 404/11 |
| 2008/0038055 | A1 * | 2/2008 | Jankovsky | B61L 29/04 404/6 |

* cited by examiner

FAN-SHAPED PEDESTRIAN BARRIER

The current state of art does not disclose the existence of pedestrian barriers of the type object of the present invention.

Retractable traffic barriers exist in a cylindrical shape or chain (bound to two external columns and sliding in the vertical direction) no type of barriers exist that involve the use of fans in micro-perforated sheet of PVC concealed in the floor.

The aim of the present invention described in the following, is that to resolve the problem of the accidental fall from the docks of trains and subway stations through the creation of floor retractable barriers, quickly opened and closed by means of pneumatic actuators and operated by the closing and opening of an electrical circuit.

With the open circuit the pedestrian barriers are in the open position in this way inhibiting the access to the tracks and accidental falls from the docks; with the arrival of the train in station, in correspondence of a stroke end, this (now stopped) mechanically closes the circuit instantaneously bringing the barriers in the floor in the retractable closure position and in this way allowing the transit of the passengers. At the restart of the train the same initial state of the pedestrian barrier is re-established.

The application of the pedestrian barriers object of the invention could be extended to the demarcation of areas closed the public, for example, in fair stands, the delimitation of walking areas during works, etc. In case of temporary applications the solution of metal casing not enclosed but positioned and blocked on the same floor by suitable means.

Figure 1:
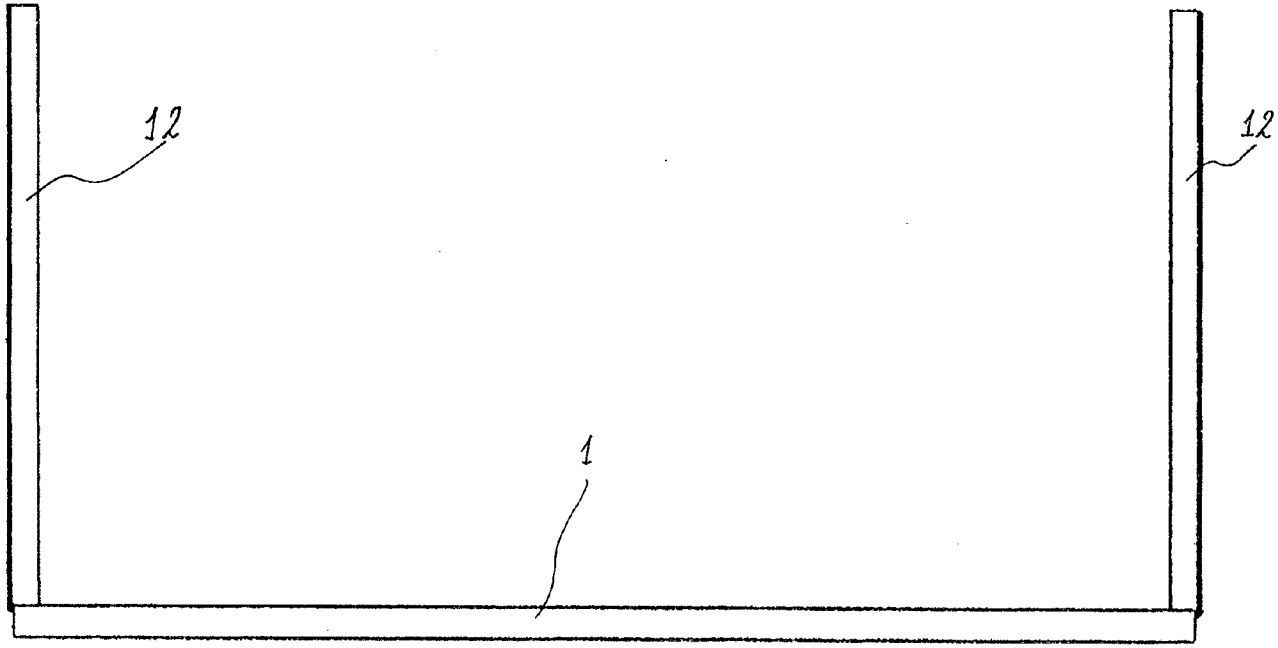
Figure 2:
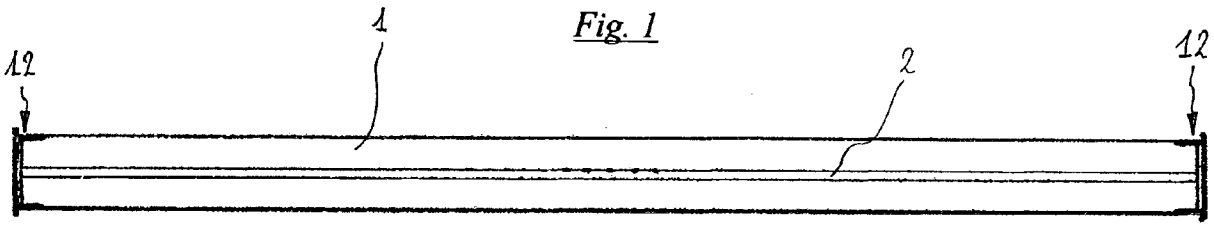
Figure 3:
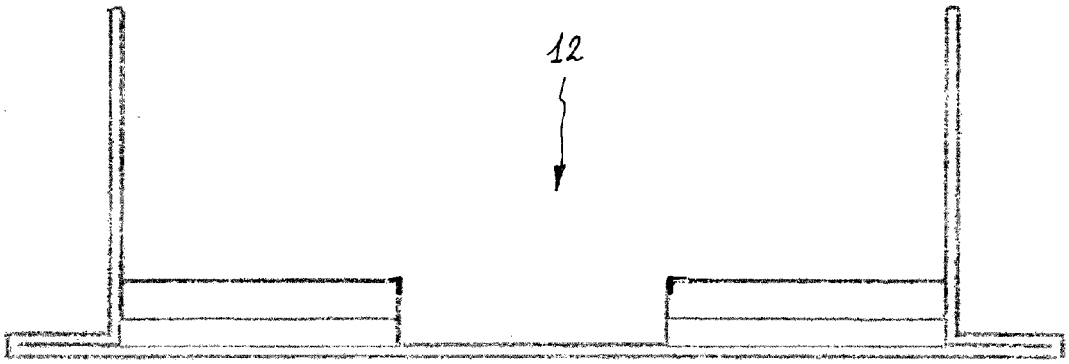
Figure 4:
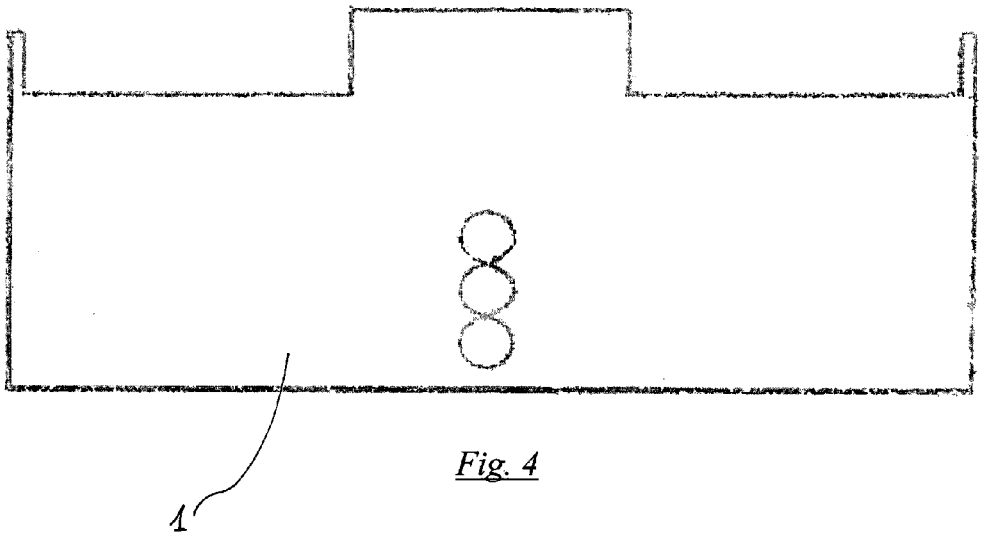
Figure 5:
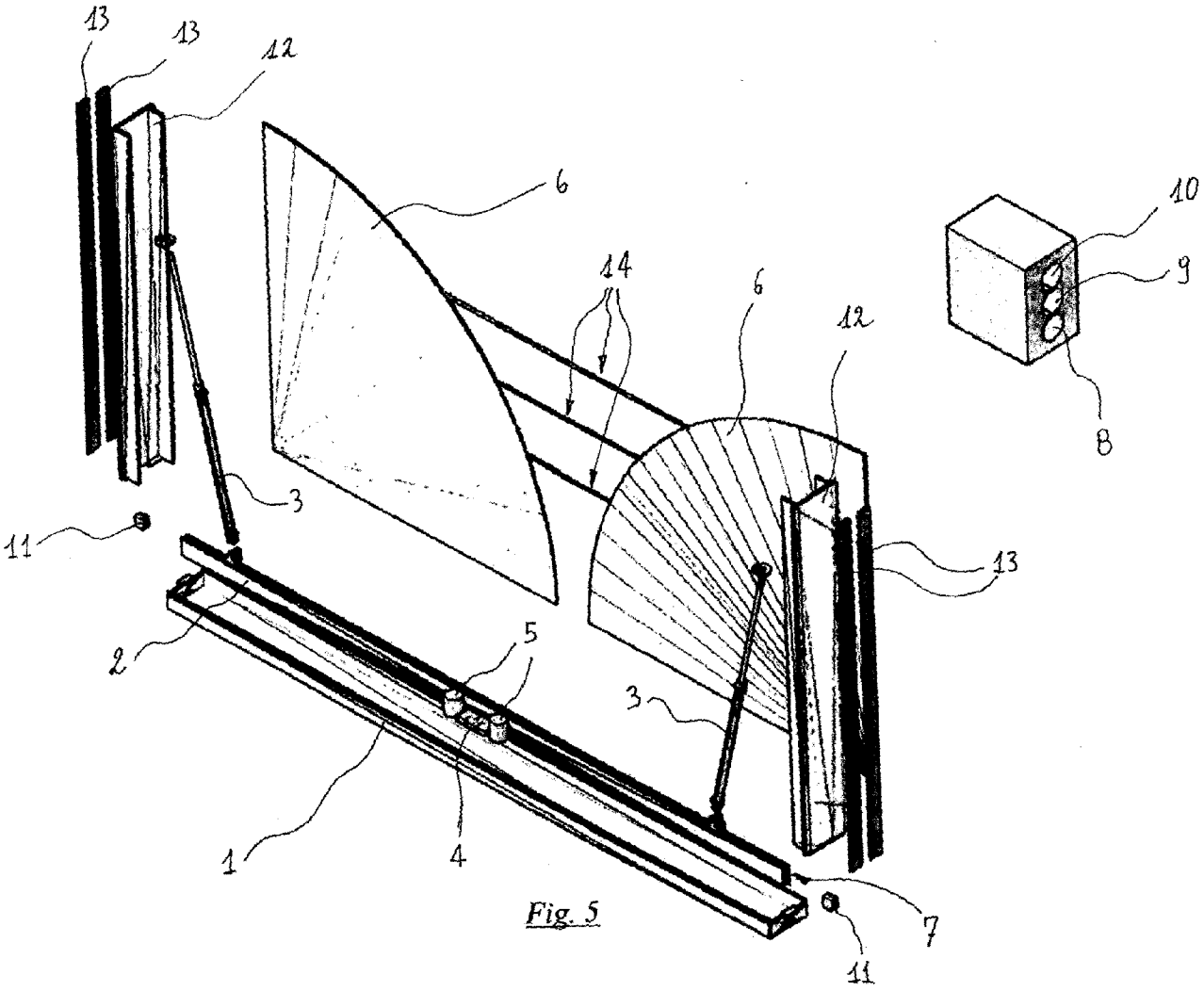
Figure 6:
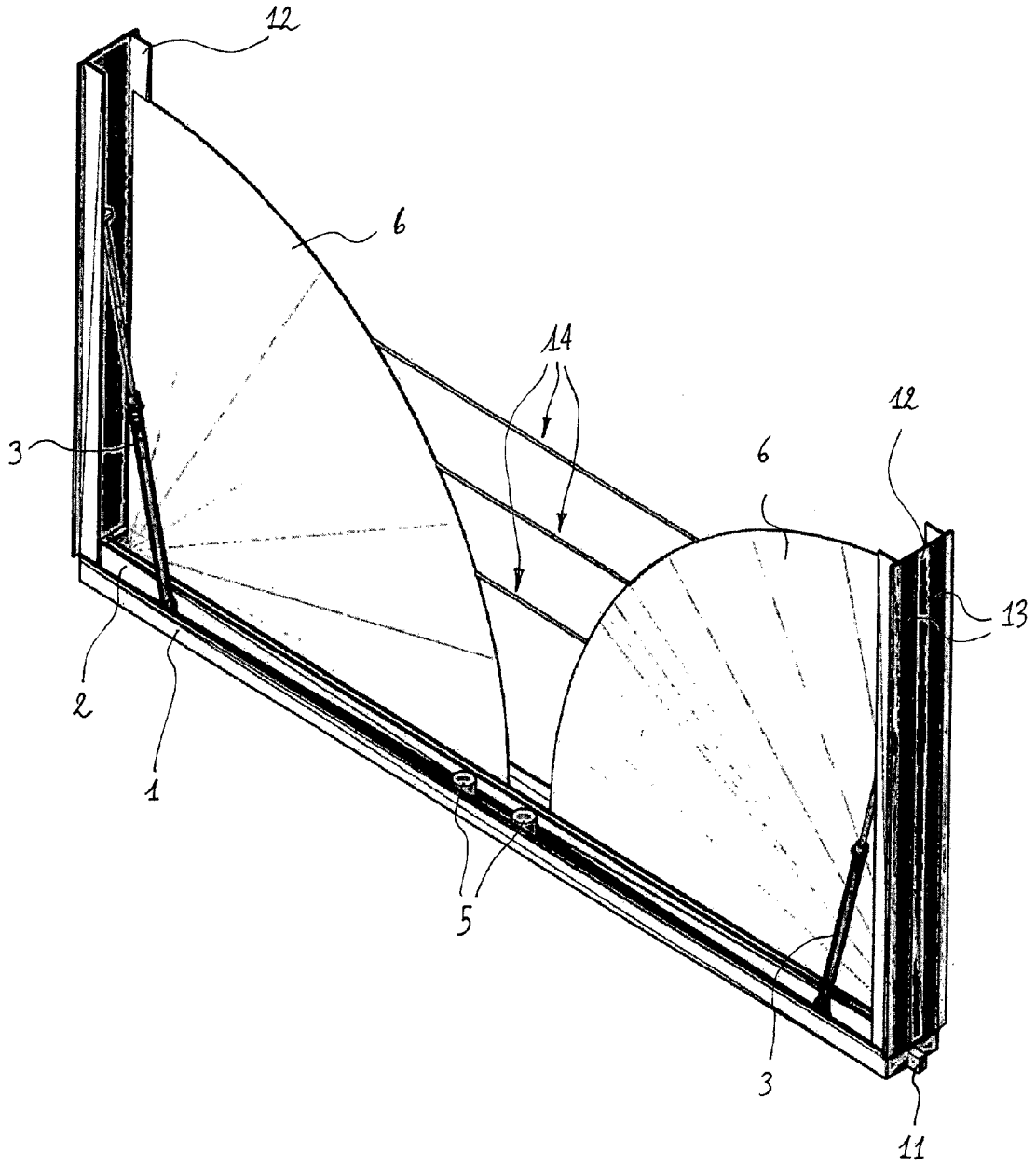

The pedestrian barrier according to the present invention is illustrated in a preferred embodiment by the figures and drawings attached that respectively illustrate:

FIG. 1—a front view of the metal casing in the opened position;

FIG. 2—a top view of the metal casing in the closed position;

FIG. 3—a cross-view of the metal casing cover;

FIG. 4—a cross-view of the metal casing;

FIG. 5—exploded view of the fan-shaped pedestrian barrier;

FIG. 6—assembled 3D view of the fan-shaped pedestrian barrier.

The single module of the pedestrian fan barrier is made of a metal casing 1 15/10 (sheet thickness referred to a mere application example susceptible of variations) of 143.2×2353×56.5 dimensions in mm (D×W×H: dimensions refer to a mere application example subject to change)

This casing is divided into two symmetrical longitudinal areas: in one area two base brackets 2 of the pneumatic actuators 3 are positioned, the electropneumatic valve 4 for actuating the pneumatic actuators 3 in a central position and two electromagnetic catches 5, in said area the actuators 3 are placed in a closing position of the barrier. In the other area the fans in PVC micro-perforated sheet 6 are positioned.

The two areas are dived by a "U" shaped metal sheet profile 15/10 (sheet thickness refers to a mere application example susceptible of variations) inside of which run parallel, one on the other, the three pipelines and, precisely, starting from the bottom, the pipeline of compressed air piping 8 connected to the electropneumatic valve 4 serving the two actuators 3, the electric pipeline 9 connected to the same valve 4 and the electric pipeline 10 connected to the two electromagnetic catches 5: at the upstream and downstream of this element there are serial connectors 11 for the connection in series of more barriers (for example along a railway platform)

The fans of PVC 6 are made of perforated sheet so as to reduce the action of the wind, one end is integral and connected to the metal casing 1, the other end to the metal case cover 12 always realized in 15/10 sheet (thickness refers to a mere application example susceptible of variations), each of the two casings is hinged to the metal case.

The actuators in the process of opening and closing move the crankcase determining the closure and opening of the fans in PVC. The crankcase in the closure position fits perfectly in the case enclosed on the floor and their covering surface is coplanar with the walking floor surface.

The two electromagnetic catches 5 are used to tighten the closure of the case cover 12. On the walking floor surface the crankcase area two longitudinal thin layers in reflective and non slip material 13 are applied.

The two fans in the open position are held in tension by means of three elastic straps 14 which have the function to inhibit the free passage between the two fans 6 and to hold in tension the same The present invention is illustrated with reference to a preferred embodiment but is not limited to the said preferred embodiment, on the contrary the scope of rights in accordance with the present invention include all modification, corrections or the like provided that these are in the object of the present invention.

The present invention lends itself well to an industrial production in large scale

The invention claimed is:

1. A pedestrian barrier comprising:

a metal sheet casing;

a pair of base brackets hinged at ends of said metal sheet casing;

a pair of metallic casing covers; and a housing-casing system having a pair of pneumatic actuators and a pair of fans comprising a PVC micro-perforated sheet, each pneumatic actuator of said pair of pneumatic actuators and each fan of said pair of fans being connected at one end to a bottom of said metal sheet casing and at another end respectively to said pair of metallic casing covers, said pair of pneumatic actuators causing a simultaneous rotation of said pair of metallic casing covers and a movement of said pair of fans.

2. The pedestrian barrier of claim 1, said metal casing comprising:

a pair of symmetrical longitudinal sectors separated by a U-shaped sheet metal profile, one of said pair of symmetrical longitudinal sectors containing said pair of base brackets and an electropneumatic valve that operates said pair of pneumatic actuators in a central position and a pair of electromagnetic catches, another of said pair of symmetrical longitudinal sectors containing said pair of fans.

3. The pedestrian barrier of claim 2, said U-shaped sheet metal profile having a compressed air piping connected to said electropneumatic valve and a first electric pipeline connected to said electropneumatic valve and a second electric pipeline connected to said pair of electromagnetic catches.

4. The pedestrian barrier of claim 3, said compressed air piping being opened and closed by said electropneumatic valve.

5. The pedestrian barrier of claim 2, said U-shaped sheet metal profile having a first serial connector and a second serial connector.

6. The pedestrian barrier of claim 1, said pair of fans being connected together by elastic straps.

7. A method of operating a pedestrian barrier, the method comprising:

opening the pedestrian barrier comprising:

closing and pressurizing a compressed air circuit;

extending stems of a pair of pneumatic actuators;

moving a metal casing cover;

opening up a pair of fans each comprising a PVC micro-perforated sheet; and maintaining the fans in an open position and under tension by elastic straps, the elastic straps inhibiting passage between the fans; and closing the pedestrian barrier comprising:

opening the compressed air circuit;

closing the stems of the pneumatic actuators;

moving the metal casing cover;

closing the fans, the fans being housed and in separate areas of a metal housing;

closing the metal casing cover; and tightening the closure of the metal casing cover by electromagnetic catches.

* * * * *